US006960039B2

(12) United States Patent
Sieling et al.

(10) Patent No.: US 6,960,039 B2
(45) Date of Patent: Nov. 1, 2005

(54) DRAWING TOOL FOR USING MULTIPLE MARKERS

(75) Inventors: Dayne A. Sieling, Calabasas, CA (US); Arie I. Aharon, Tarzana, CA (US); Antonio C. Hu, Los Angeles, CA (US); Joseph Sherman, Sherman Oaks, CA (US); Charles P. Davis, Torrance, CA (US)

(73) Assignee: Overbreak, L.L.C., Sun Valley, CA (US)

( * ) Notice: Subject to any disclaimer, the term of this patent is extended or adjusted under 35 U.S.C. 154(b) by 0 days.

(21) Appl. No.: 10/441,954

(22) Filed: May 20, 2003

(65) Prior Publication Data

US 2004/0253034 A1 Dec. 16, 2004

(51) Int. Cl.[7] ..... B43K 27/04
(52) U.S. Cl. ..... 401/35; 401/34; 401/29
(58) Field of Search ..... 401/29, 17, 23, 401/34, 35, 48, 198, 199; D19/55

(56) References Cited

U.S. PATENT DOCUMENTS

| | | | | | |
|---|---|---|---|---|---|
| 2,608,953 | A | * | 9/1952 | Kollsman | 401/35 |
| 6,010,266 | A | | 1/2000 | Schrepf | |
| 6,033,139 | A | * | 3/2000 | Dutcher | 401/35 |
| 6,149,330 | A | | 11/2000 | Chuang | |
| 6,491,464 | B1 | * | 12/2002 | Young | 401/35 |
| 6,554,517 | B2 | * | 4/2003 | Ahmed | 401/35 |

FOREIGN PATENT DOCUMENTS

| | | |
|---|---|---|
| DE | 4123990 | 12/1992 |
| WO | WO 03/008203 | 1/2003 |

* cited by examiner

*Primary Examiner*—David J. Walczak
(74) *Attorney, Agent, or Firm*—Blakely, Sokoloff, Taylor & Zafman LLP

(57) ABSTRACT

A drawing tool for creating stripped patterns or multi-colored lines, such as rainbows. The drawing tool includes a set of removable cartridges of varying sizes, nib shapes and colors, each of which is interchangeable with others of its own size or with a set ratio of lager or smaller cartridges.

11 Claims, 8 Drawing Sheets

DRAWING TOOL FOR USING MULTIPLE MARKERS

BACKGROUND

1. Field of the Invention

The invention relates to drawing tools. Specifically this invention relates to a drawing tool that allows several markers to be used simultaneously, the individual markers being replaceable and interchangeable.

2. Background

Conventional drawing utensils are primarily based on a pen or pencil design. A user grips the cylindrical body of the drawing utensil with the marking end pointing away from the user. The nib (i.e., the marking portion) of the utensil is applied to a flat surface of a receiving medium such as paper or canvas in order to color or mark its surface.

Conventional markers are examples of drawing utensils. A conventional marker is a cylindrical tool with a nib protruding from the distal end. Ink is stored within the cylindrical body of the marker. The nib may have a removable covering or cap that protects the nib from drying out. A user grips the marker by the cylindrical body and applies the nib to a surface to dispense ink onto that surface. Each mark contains a single color of ink. Different colored markers may be used individually to create a picture or drawing.

BRIEF DESCRIPTION OF THE DRAWINGS

Embodiments of the invention are illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION

Figure 1A:
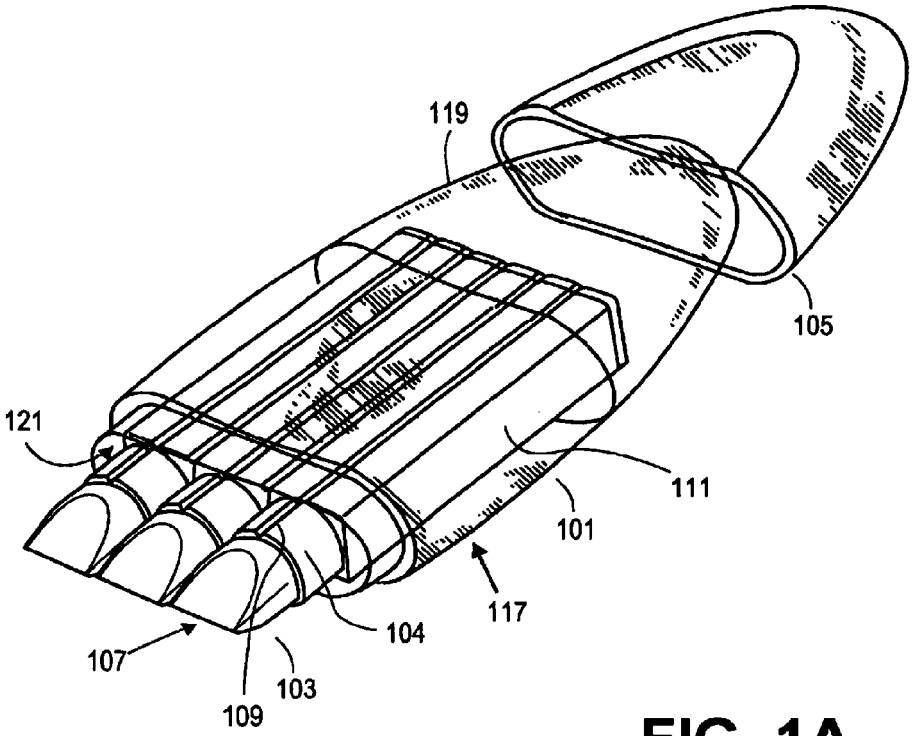
FIG. 1*a* is an illustration of a drawing tool with its cap removed.

FIG. 1*a* is an illustration of a drawing tool 101 for using multiple markers. Drawing tool 101 includes main housing 117. Main housing 117 may be constructed of plastic, including thermoplastic and thermoset plastic, metal, natural materials or similar materials. Housing 117 defines an interior compartment or set of compartments for holding a set of cartridges 111. In one embodiment, housing 117 is translucent enabling a user to easily discern the colors, number and placement of markers within the housing 117. Markers are composed of a cartridge 111 and nib 103. In another embodiment, housing 117 is opaque.

In one embodiment, cartridges 111 have a squared or block shaped body. A single housing 117 may have sufficient space to hold several cartridges depending on the size of the cartridges 111. In another embodiment, cartridges may have any shape, including cylindrical, triangular or similar shape. The interior chamber of housing 111 has a complementary shape to the shape of the cartridges 111 to be placed therein in order to facilitate holding the cartridges 111 in a firm position while the drawing tool 101 is in use.

In one embodiment, cartridges 111 may be inserted into the back end of drawing tool 101. A cover 119 may be snap fitted, latched or similarly connected to housing 117. Cover 119 may be removed to provide access to cartridges 111. Cartridges 111 slide into housing 117 nib 103 first. They are limited from exiting housing 117 at the front of marker 101 by the shape of a nib port 121, which allows the nib 103 of cartridge 111 to protrude but prevents the wider body from moving forward.

In one embodiment, drawing tool 101 has a set of ridges extending along the length of the walls of an interior cavity of the drawing tool 101. These ridges serve to guide the placement of cartridges 111 within the drawing tool 101. The ridges may match the width of a cartridge defining a set of slots in which to place each cartridge 111. The ridges may match a groove in the cartridge 111 to guide its orientation and placement within the cavity. These ridges may interact with the cartridges to define their positions dependent on the size of the cartridges. A small size cartridge may fit in a ridge-defined slot. A medium sized or large size cartridge may have matching grooves for the same ridge pattern.

In one embodiment, each cartridge has a groove 109 along its outer surface. This groove 109 has a shape that is complementary to a ridge in the interior cavity of housing 117. The ridge must be matched with groove 109 in order to fit cartridge 111 into its slot. Aligning the ridge and groove 109 also aligns nib 103 of cartridge 111 so that it is properly oriented in relation to drawing tool 101 or the nibs of other cartridges. The ridge guides the cartridge as it slides forward preventing the nib 103, if exposed, from contacting the inner surface of housing 117 thereby protecting the inner surface from repeated ink markings. Cartridges 111 slide forward until nib 103 reaches a nib port 121 of drawing tool 101 at the front end. Nib port 121 has dimensions that are less than that of the body of cartridge 111 thereby preventing cartridge 111 from sliding out through the front of drawing tool 101. However, the nib 103 of cartridge 111 has a smaller dimension than the body allowing it to pass through nib port 121.

In another embodiment, cartridges may be front loaded by a user. A face of nib port 121 may be removed or altered to provide sufficient space to place the body of cartridge 111 into housing 117. The face is replaced or nib port 121 returned to its original dimensions. The movement of the cartridge 111 through the interior of the drawing tool 101 is guided by the complementary groove 109 and ridge combination. The back end of the interior cavity is a limiting wall of the housing preventing the cartridge 111 from sliding past the position where the nib 103 of the cartridge 111 protrudes a desired distance from the front end of the drawing tool 101.

In another embodiment, the groove and ridge structure may be reversed with grooves in housing 117 and ridges on cartridges 111. Similar engagement and guidance structures may be used to replace the groove and ridge structure or in combination with it. A form fit, rail, tapered fit, or similar guidance structure may be used. In a further embodiment, cartridges may be clamped, latched, snap-fit or similarly held in place.

In one embodiment, housing 117 may define sufficient space for three medium sized cartridges 111. Each cartridge 111 is a sealed container for holding an ink or similar liquid having a single outlet at its distal end. In one embodiment, the outlet is filled by a nib 103 that protrudes from the cartridge 111. Nib 103 is composed of plastic, fiber, felt or similar material for dispensing ink and similar liquids at a predetermined rate. In one embodiment, nib 103 may have a chisel like shape with a linear surface 107 for a nib. Nib 103 is connected to a tampon in the interior of the cartridge, which is an absorbent material that holds the majority of the ink and maintains a supply of ink to nib 103. In one embodiment, nib 103 has flange structures, which when used expand the width of the nib. These expanding flanges may fill in all or most of the gaps between the nibs 103 of drawing tool 101 to allow the creation of a striped or rainbow pattern without any gaps or with minimal gaps between the stripes. The flanges are sized so as to avoid contact with neighboring nibs to prevent bleeding of ink between nibs. In another embodiment, a roller ball or similar dispensing mechanism is attached to the cartridge 111 outlet.

In one embodiment, the dimensions of each cartridge 111 body are roughly equivalent such that each cartridge 111 may be removed from drawing tool 101 and replaced by a standard sized cartridge, for example when one cartridge is empty. Similarly, the position of each cartridge 111 is interchangeable in drawing tool 101. Each cartridge has the same groove structure or similar guidance structure to guide it into the desired position in drawing tool. Each cartridge may contain an ink of a different color, contain special ink such as a 'magic ink' a clear ink that reacts with other inks to alter their color, or contain a similar marking liquid. The cartridges can be arranged by desired color within drawing tool 101 to allow the easy creation of multicolor stripes or rainbows by applying drawing tool 101 to a surface with a single stroke. Multiple cartridges of the same color ink may be used to get a wider ink swath from each stroke.

In another embodiment, cartridges 111 may have varying sizes. Cartridges of varying sizes may be interchangeable in defined ratios. A small size cartridge may have cartridge body dimensions roughly half that of a medium size cartridge. Two small size cartridges can then be placed in a medium size chamber or holding structure. The combination of cartridges can be mixed and matched to create a drawing tool 101 with the desired combination of colors and marker nib sizes.

Figure 1B:
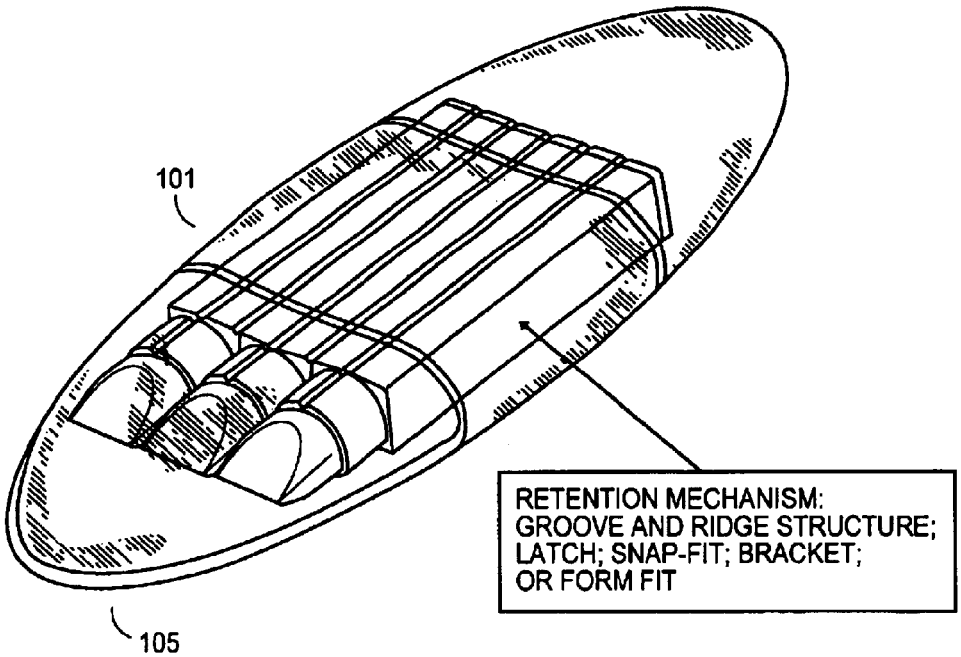
FIG. 1*b* is an illustration of a drawing tool with its cap covering a set of nibs.

In one embodiment, a cap 105 covers the nibs 103 of cartridges 111 when in a closed position. FIG. 1*a* shows the cap in an open position. The cap when in an open position can be attached to the rear of drawing tool 101 by a form fit, snap fit, latch or similar mechanism. FIG. 1*b* shows drawing tool 101 with cap 105 in a closed position. Cap 105 in the closed position creates a seal around nibs 103 of cartridges 111 preventing the flow of air across the nibs and thereby preventing the drying out of nibs 103 and cartridges 111 when not in use.

Figure 2A:
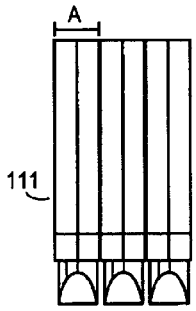
FIG. 2*a* is an illustration of a medium sized set of marker cartridges.
Figure 2B:
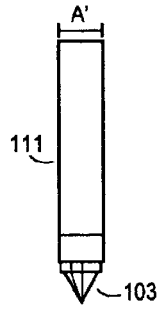
FIG. 2*b* is an illustration of a side view of the medium sized marker cartridge of FIG. 2*a*.
Figure 2C:
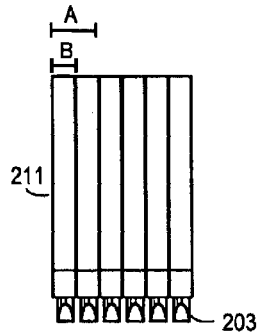
FIG. 2*c* is an illustration of a small sized set of marker cartridges.

FIG. 2*a* is an illustration of a set of medium sized cartridges 111. Each cartridge has a roughly identical body dimension with a width A. In one embodiment, the width of the medium sized cartridge is nine millimeters (mm). FIG. 2*b* is an illustration of a side view of the medium sized cartridge 111 having a chisel shaped nib 103. This cartridge is medium sized with a height A'. FIG. 2*c* is an illustration of a set of small sized cartridges. Small cartridges 211 have a width B that is approximately half the width of medium sized cartridges 111 having width A. Thus, two small cartridges 211 can replace a single medium size cartridge 111. In one embodiment, small cartridge width is approximately four millimeters. A and A' may be but need not be equal.

In one embodiment, small cartridges 211 have beveled edges such that two together form a groove similar to the groove of a medium sized cartridge. The beveled edges and ridge of the housing guide a cartridge 211 during insertion and hold a cartridge in place with a form fit. Each smaller cartridge 211 has a nib 203 with the same basic shape as the medium sized cartridge nib 103 such as pointed, chisel shaped and similar shapes. In another embodiment, the small cartridges 211 have straight edges and fit between the ridges of the housing.

Figure 2D:
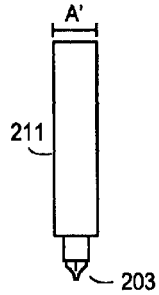
FIG. 2*d* is an illustration of a side view of the small sized marker cartridge of FIG. 2*c*.

FIG. 2*d* illustrates a side view of a small sized cartridge 211 having a small sized nib 203. The small sized cartridge 211 has a height A' matching the height of the medium sized cartridge 111. The sizes of cartridges can be any size appropriate for being held by a user in sets of one or more. The cartridge body dimensions of height, width and length can be varied such that a standard height, width and length are used for all cartridges. The relative height and width of cartridges can be varied such that the cartridge may have a roughly elongated square or rectangular shape. In another embodiment, the cartridges may have cylindrical, triangular or similar shaped body.

Figure 2E:
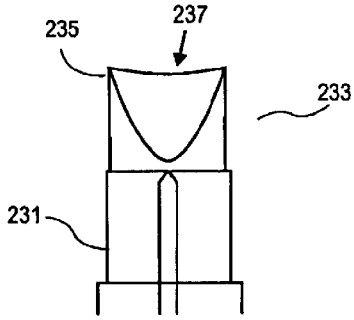
FIG. 2*e* is an illustration of a flanged nib.

FIG. 2*e* is an illustration of the nib end of a cartridge 231 with a nib 233 having flanged edges. Cartridge 231 and nib 233 may be of any size. Nib 233 has flanged edges 235. Flanged edges 235 are flexible portions of the nib that bend to elongate the width of nib 233. In one embodiment, flanged edges 235 may be created by forming a typical chisel shaped nib 233. The nib is given a concave shape by cutting out a central convex section of the linear tip 237 surface of nib 233. This results in a concave nib 233 shape including pointed or flanged edges 235.

Figure 2F:
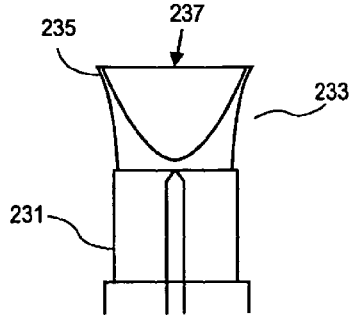
FIG. 2*f* is an illustration of the flanged nib of FIG. 2*e* in an expanded position.

FIG. 2*f* illustrates nib 233 in an expanded position. Nib 233 may be in an expanded state when pressed against a surface or under similar circumstances. The flanges 235 expand the width of the nib tip 237. This enables the drawing of broader lines with less gap between the lines drawn by cartridges in a drawing tool such as described herein. The flanges are sized to prevent contact with nibs including other flanged nibs in adjacent cartridges to prevent the bleeding of ink between the nibs. Flanges 235 also function to provide a broader nib while allowing the nib to pass through the interior cavity and through the nib port 121 defined by the housing 117 without marking the interior of drawing tool 101 or obstructing the sliding of the cartridge.

Figure 3:
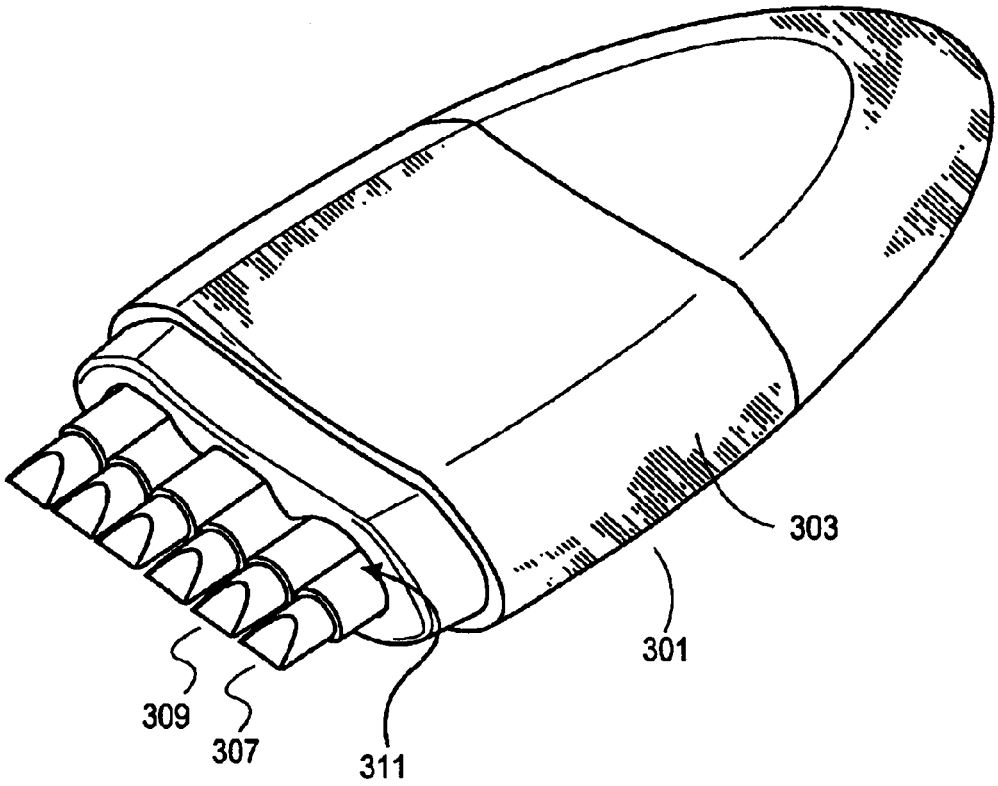
FIG. 3 is an illustration of a drawing tool with a set of small markers.

FIG. 3 is an illustration of a drawing tool 301 housing a set of small cartridges 307. Two small cartridges 307, 309 are disposed within housing 303 in place of a single medium size cartridge. Nib port 311 is a single continuous opening in housing 303. The nib port 311 opening may have any shape that allows the nibs of small and medium cartridges to protrude from drawing tool 301 when the drawing tool cap is in an open position.

Figure 4A:
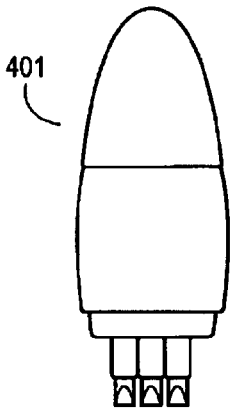
FIG. 4*a* is an illustration of small size drawing tool.
Figure 4B:
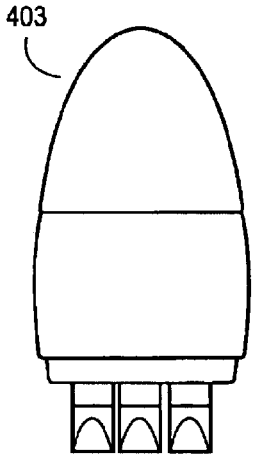
FIG. 4*b* is an illustration of a medium size drawing tool.

FIGS. 4*a*–4*d* illustrate different size drawing tools, and cartridge configurations demonstrating the interchangeability and flexibility of the drawing tool design. FIG. 4*a* is an illustration of a small size drawing tool 401. Small drawing tool 401 can accommodate three small markers. In another embodiment, small drawing tool 401 may accommodate two through five small markers and one or two medium sized markers or various combinations thereof. FIG. 4*b* is an illustration of a medium sized drawing tool 403, which can accommodate three or more medium markers, six or more small markers or combinations thereof. Cartridge slots may be left open so that fewer markers of any size may be used in any size drawing tool.

Figure 4C:
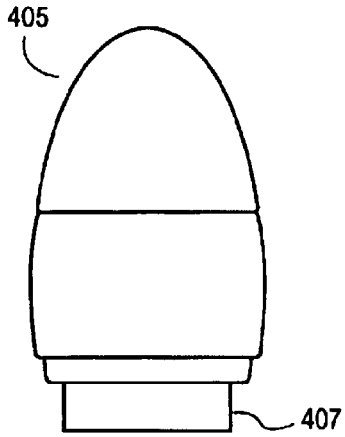
FIG. 4*c* is an illustration of a large size drawing tool.

FIG. 4*c* is an illustration of a large drawing tool 405 including a large marker 407. A large marker may have any ratio to medium or small marker that is a ratio of whole numbers. In one embodiment, the large marker 407 has a ratio of one to three with the medium markers. In one embodiment, the large marker 407 has two sets of grooves in the cartridge body to allow it to slide into three chambers defined with the housing by two dividing ridges. In one embodiment, large marker 407 has a width of thirty millimeters. The large marker 407 may employ any of the guidance or attachment structures used by the medium or small sized cartridges.

Figure 4D:
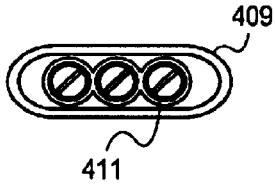
FIG. 4*d* is an illustration of a medium size drawing tool with angled nib position.

FIG. 4*d* is an end view illustration of a drawing tool 409 having an angled nib configuration. In one embodiment, drawing tool 409 houses the cartridges at an angle such that the flat linear edge of each nib 411 is set at an angle from the central plane of the drawing tool. The angle allows a striped rainbow pattern to be drawn in a single stroke having a minimal or no gap between the lines of the pattern. Also, this allows colors in a striped pattern to be deliberately overlapped depending on the angle at which the stroke is made. In another embodiment, an angled grip in line with the angle of the nibs 411 is provided to assist the user in drawing a striped pattern. The angled grip may be a part of the housing or attached to the housing of the drawing tool 409.

Figure 5:
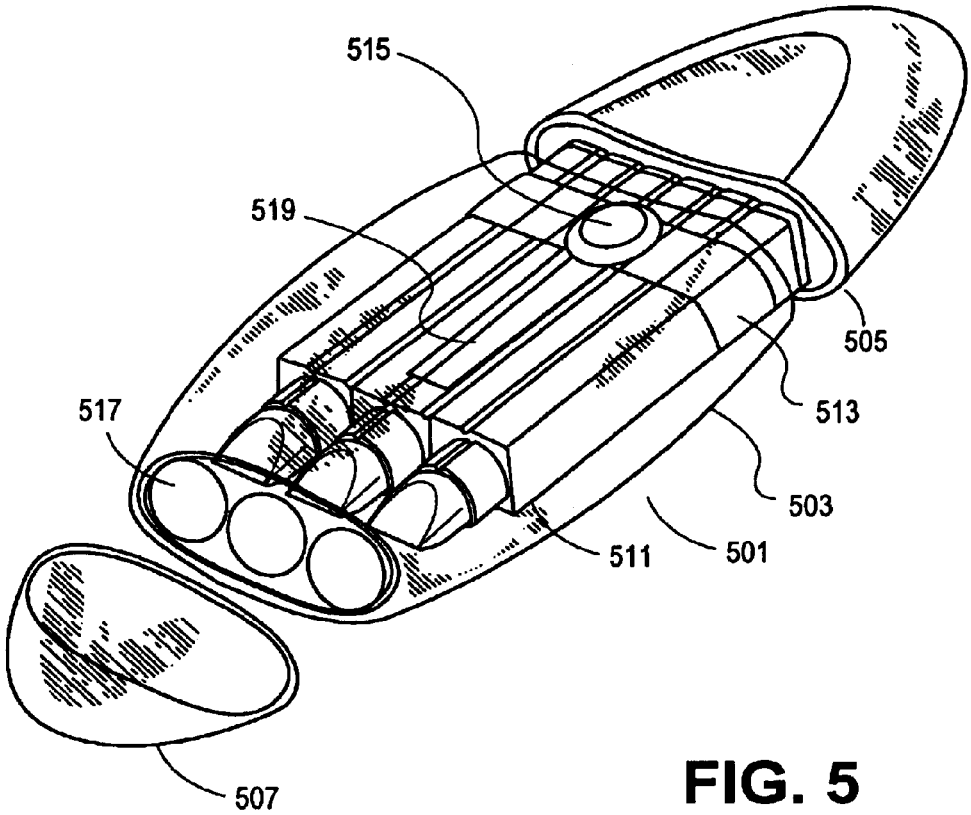
FIG. 5 is an illustration of a retractable drawing tool.

FIG. 5 is a drawing tool with retractable cartridges. In one embodiment, drawing tool 501 includes a base housing 503 and a rear cap 505 to allow access to cartridges 511 for replacement and exchange. An optional cap 507 is removably attached to cover the nib ports 517. Each cartridge 511 is removably attached to brace 513. Brace 513 includes a mechanism such as a form fit, snap fit, latch or similar device to hold each cartridge 511. Brace 513 is attached to slide 515 through slit 519. A user moves slide 515 to advance or retract the nibs of cartridges 511 through nib port 517. In one embodiment, slide 515 locks into the advanced and retracted positions by a snap fitting, latching mechanism, friction fit, or similar device. In another embodiment, retracting and advancing the cartridges causes doors on nib ports 517 to open and close to prevent the nibs from drying out while not in use in the retracted position.

Figure 6:
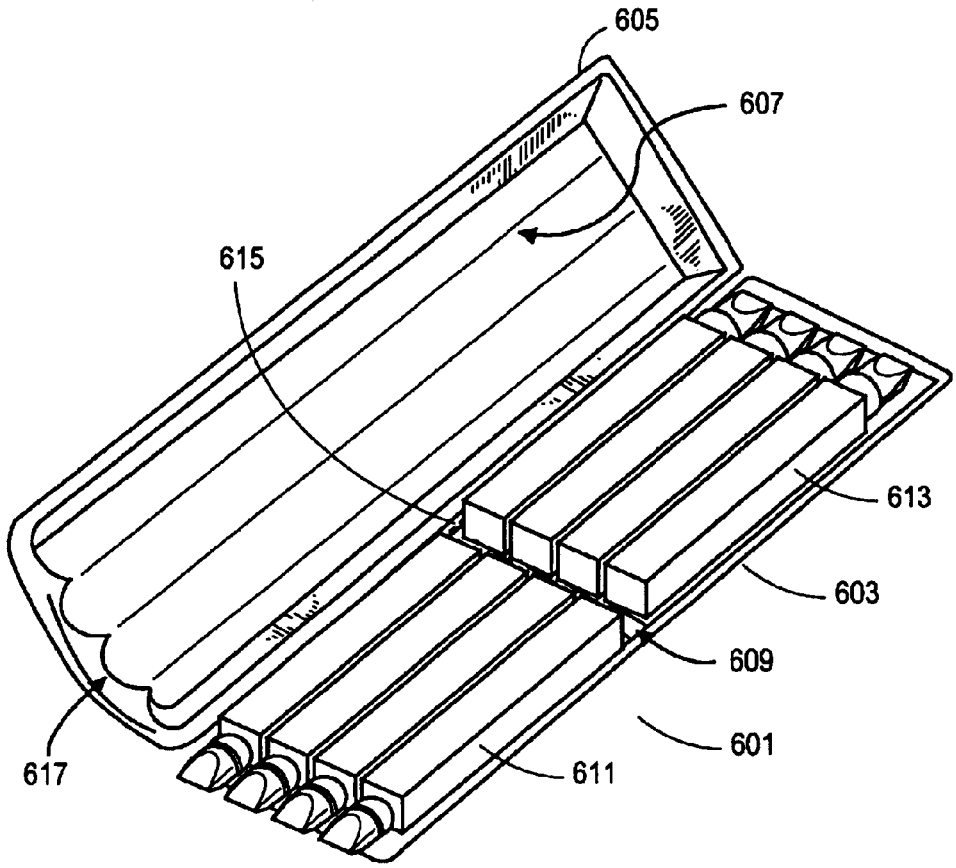
FIG. 6 is an illustration of a hinged case drawing tool.

FIG. 6 is an illustration of a hinged marker with extra storage space for spare cartridges. In one embodiment, drawing tool 601 includes a lower housing 603 and an upper housing 605. Lower housing 603 is coupled to upper housing by a hinge mechanism 615 or similar mechanism. In the open position, drawing tool 601 allows access to cartridges 611 whose nibs are positioned for use and cartridges 613 in a storage area of drawing tool 601. Upper housing 605 and lower housing 603 are held together by a latch, snap fit, form fit or similar mechanism when in a closed position. A set of ridges 607 in the upper housing 605 and lower housing 603 define positions for small cartridges 613, medium cartridges or large cartridges to be inserted interchangeably. A limiting wall or ridge 609 prevents cartridges 611 from sliding out of position along with the ridges 607 and contours of the exit port 617.

Figure 7:
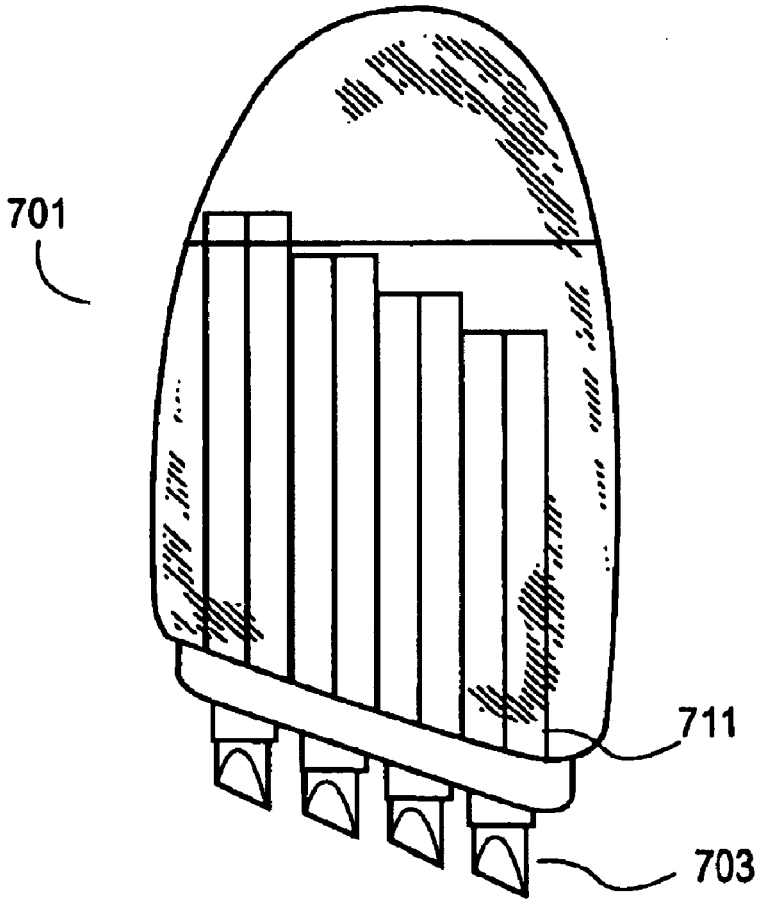
FIG. 7 is an illustration of a tiered marker drawing tool.

FIG. 7 is an illustration of a tiered drawing tool 701. In one embodiment, drawing tool 701 retains standard cartridges 711 in a tiered alignment. Nibs 703 of cartridges 711 each protrude a set distance from the drawing tool 701. In one embodiment, nibs 703 have angled outer edges in line with the angle of the cartridge arrangement to create a linear alignment of outer nib edges to facilitate the application of the nibs 703 to a surface to be marked. This configuration may facilitate drawing by providing a more natural resting and gripping angle for a user when holding drawing tool 701 and applying it to mark a surface.

Figure 8:
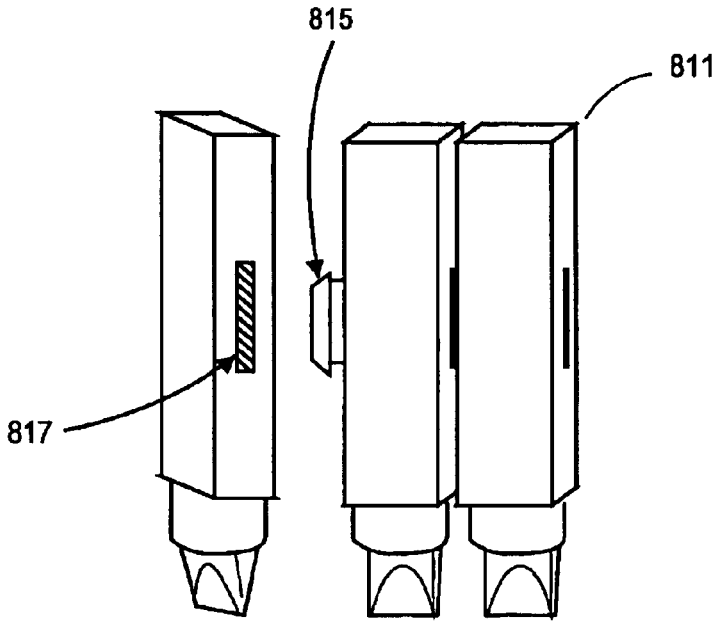
FIG. 8 is an illustration of a snap fit marker set.

FIG. 8 is an illustration of a set of cartridges that can be directly coupled to one another in an interchangeable manner. In one embodiment, each cartridge 811 has a male coupling 815 and female coupling 817. Any cartridge 811 with the male female coupling mechanism may be coupled to any other cartridge with at least a male or female coupling. Cartridge 811 with both male and female couplings is interchangeable with any other cartridge with the same coupling mechanism. Thus, cartridges may be coupled together to form a single drawing tool allowing a user to determine the cartridges to be used in the combined drawing tool. The couplings are positioned to connect the cartridges 811 in any order allowing a user to determine the pattern to be drawn. The couplings also position the nibs of the cartridges to have a matching orientation in order to produce a defined pattern, such as a stripe pattern when stroked across a surface. In another embodiment, alternative coupling mechanisms may be employed including matching tongue and groove sections, latches, clamping devices, snap-fit or similar coupling devices.

In another embodiment, each cartridge 811 has a female connection 817 on each side and discrete double-sided male connectors 815 are provided to permit maximal interchangeability of cartridges. Other embodiments contemplate interconnection with tongue and groove mechanisms, snaps, releasable adhesive, hook and loop material or any other manner in which the cartridges may be retained in interchangeable relation to each other.

In the foregoing specification, the invention has been described with reference to specific embodiments thereof. It will, however, be evident that various modifications and changes can be made thereto without departing from the broader spirit and scope of the invention as set forth in the appended claims. For example, an extra compartment in any of the designs may be included for the storage of markers. The general features of interchangeability, cartridge access mechanisms, retraction mechanisms, nib protection mechanisms and similar structures may be used in combination or omitted from any design in the spirit and scope of the invention. The specification and drawings are, accordingly, to be regarded in an illustrative rather than a restrictive sense.

What is claimed is:

1. An apparatus comprising:

a housing defining at least one cavity;

a plurality of cartridges removably coupled to the housing and disposed within the at least one cavity, a plural subset of the plurality of cartridges positioned to concurrently dispense a marking fluid when in use, and a nib coupled to a cartridge of the plurality of cartridges to dispense the marking fluid, wherein the nib tapers to a curved surface, and wherein each end of the curved surface flares when the curved surface is in contact with another surface.

2. The apparatus of claim 1, further comprising:

a cap removably coupled to the housing to encase the nib.

3. A device comprising:

a drawing tool including at least one coupling mechanism to attach at least one cartridge to a drawing tool;

at least one cartridge removably coupled to the drawing tool; and a plurality of cartridges having a first size, wherein the coupling mechanism can interchangeably retain one of the at least one cartridge and a plurality of cartridges.

4. The device of claim 3, further comprising:

a first cartridge having a second size; and a second cartridge having a third size, wherein the coupling mechanism can interchangeably retain one of the first cartridge and the second cartridge.

5. The device of claim 3, further comprising:

a compartment defined by the drawing tool to store the at least one cartridges, wherein a nib of a cartridge is not exposed.

6. The device of claim 3, wherein the coupling mechanism positions a plural subset of the plurality of cartridges such that each nib of the plural subset of the plurality of cartridges protrudes from the drawing tool a predetermined distance.

7. The device of claim 3, wherein at least two cartridges are removably coupled to the drawing tool, and wherein each tip of the at least two cartridges is in a linear configuration.

8. The device of claim 3, wherein the coupling mechanism is a form fit between the at least one cartridge and the drawing tool.

9. The device of claim 3, wherein the coupling mechanism positions each of the tips of the at least one cartridge at an angle from a central plane of the drawing tool.

10. An apparatus comprising:

a first means for dispensing a marking liquid;

a means for housing a first means for dispensing the marking liquid including a means for removably coupling the first means for dispensing the marking liquid to the means for housing; and a second means for dispensing a marking liquid that is interchangeably coupleable to the means for housing with the first means for dispensing the marking liquid, the second means for dispensing having a different size than the first means.

11. The apparatus of claim 10, further comprising:

a means for retracting the means for dispensing the marking liquid to a position in the housing where the means for dispensing the making liquid are not exposed.

* * * * *